US005125207A

United States Patent [19]

Strobl, Jr. et al.

[11] Patent Number: 5,125,207

[45] Date of Patent: Jun. 30, 1992

[54] METHOD FOR ASSEMBLING A SPACE ENCLOSURE STRUCTURE

[76] Inventors: Frederick P. Strobl, Jr., 204 N. Shore Dr., Cary, Ill. 60013; Jack E. Glatt, 134 S. Hills Dr., Barrington, Ill. 60010

[21] Appl. No.: 669,476

[22] Filed: Mar. 14, 1991

Related U.S. Application Data

[62] Division of Ser. No. 385,871, Jul. 26, 1989, abandoned.

[51] Int. Cl.[5] ..... E04B 1/32

[52] U.S. Cl. ..... 52/747; 52/86; 52/90; 52/483; 52/780; 52/729; 52/748

[58] Field of Search ..... 52/86, 90, 301, 476, 52/483, 726, 227, 747, 748, 780, 781; 29/446, 897.3

[56] References Cited

U.S. PATENT DOCUMENTS

| | | | |
|---|---|---|---|
| 2,912,076 | 11/1959 | Costis | 52/781 X |
| 3,010,547 | 11/1961 | Foster | 52/781 X |
| 3,341,990 | 9/1967 | Mouton, Jr. | 52/476 |
| 4,068,440 | 1/1978 | Lillethorup | 52/301 |
| 4,785,599 | 11/1988 | Murphy | 52/301 X |
| 4,835,921 | 6/1989 | Baggett, Jr. et al. | 52/729 X |

FOREIGN PATENT DOCUMENTS 139335 6/1934 Fed. Rep. of Germany .

*Primary Examiner*—David A. Scherbel
*Assistant Examiner*—Robert Canfield
*Attorney, Agent, or Firm*—Staas & Halsey

[57] ABSTRACT

A mullion structure for enclosing sun spaces consisting of a system of straight and curved beams for supporting transparent plastic panels. The beams have cross-sectional configurations presenting end flanges which facilitate end-to-end and/or perpendicular attachment and side flanges presenting rabbets for receiving and enclosing the edges of the panels. Elongated spars having longitudinally extending rabbets are formed by joining the curved beams together in end-do-end relationship. The spars are connected to a host structure using a torsion relieving system which is made up of a torsion beam extending perpendicularly from the spar and a load bearing plate attached to the host structure. The spars are laterally flexible so that the panels may be inserted into the rabbets and flexed to assume the shape of the spars after the spares are secured to the host structure. All operations necessary for erecting the structure may be conducted from inside the space being enclosed.

5 Claims, 10 Drawing Sheets

62
59
50
22
61
64
50
52
52
28
52
52
28
59
66
60

METHOD FOR ASSEMBLING A SPACE ENCLOSURE STRUCTURE

This application is a division of application Ser. No. 07/385,871, filed July 26, 1989, now abandoned.

BACKGROUND OF THE INVENTION

1. Field of the Invention

The present invention relates to the field of structures for enclosing sun spaces such as decks and patios and the like and to components and methods which are useful in connection with the erection and/or assembling of such structures. In particular the invention relates to a system of curved and straight standardizable plastic beam members that may be used to form a graceful mullion support structure for transparent plastic panels.

2. The Prior Art Background

As modern life has developed it has become desirable for persons to expand the useful living spaces of their dwellings by enclosing or at least covering outdoor areas with simple structures. In Northern climates it has also become desirable to provide completely enclosed structures. Such structures are often expensive to construct and heat in the winter and when constructed of metallic structural components and conventional glass the structures suffer from excessive heat build-up in the summer, heat loss in winter and a lack of privacy due to the transparency of the glass. Additionally, structural additions to existing homes often lead to bureaucratic difficulties in obtaining construction permits and zoning clearances. Moreover, presently known structures are difficult to utilize in open areas on top of buildings, for example, due to the fact that the workmen involved in construction must often use cranes and generally must work on the outside of the structure in a precarious position. Accordingly, improved products for the market place are always being sought.

SUMMARY OF THE INVENTION

The present invention provides practical solutions for many of the above described pre-existing problems in the sun space enclosure field. The structures, components and methodology of the invention are inexpensive to purchase and implement and provide relief in such areas as excessive heat build-up, labor costs and the obtaining of building and/or construction permits. Moreover, when the components of the present invention are utilized the structure may be erected from the inside of the space thus relieving the problems encountered when structures are erected in spaces on top of buildings.

In accordance with the concepts and principles of the present invention, beam members are provided for supporting sheets of construction material such as plastic panels. The beam members are straight or curved and each comprises an elongated, generally planar, central web element. The web element has longitudinally spaced opposite ends and laterally spaced, longitudinally extending opposite edge portions. An outer flange member is rigidly connected to the web element at each of its edge portions and each such outer flange member extends longitudinally of the web along the corresponding web portion and transversely outwardly away from the web element. The beam member also comprises an inner flange for each of the outer flange members. Each of the inner flanges is also rigidly connected to the web element at a location between the outer flange members, and the inner flanges extend longitudinally of the web element from one of the its ends to the other. The inner flanges also extend transversely outwardly away from the web element to present an outer edge, and the same are disposed in laterally spaced, generally parallel relationship relative to the corresponding outer flange member to present a rabbet therebetween extending longitudinally of the web element for receiving the edge of a sheet of construction material. Additionally, the beam member comprises an end flange extending laterally across the web element between the inner flanges at at least one end of the web element. The end flanges may also be rigidly connected to the web element and disposed to extend transversely outwardly away from the web element.

Preferably an end flange is provided at each end of the web and each of the end flanges is connected to both inner flanges. The beam members preferably comprise a unitary integral injected molded article formed from a polycarbonate resin.

In accordance with the invention, the beam members may be straight or curved longitudinally about an axis which extends generally perpendicularly through the plane of the central web. Such components may then be interconnected to provide a mullion structure consisting of elongated, generally vertically extending spars and horizontal cross beams.

The invention also provides elongated spars comprising a plurality of beam members as described above arranged in end-to-end relationship, with at least one end flange of each beam member disposed in mated, contacting relationship with an end flange of another beam member and with the rabbets of the beam members disposed in longitudinal alignment. Such spars include nut and bolt means for holding the mated flanges together. In particular, curved elongated spars are provided by thus connecting a plurality of curved beam members together.

The invention further provides a support structure for supporting a sheet of construction material comprising at least two beams as defined above. The beams are arranged to extend perpendicularly with respect to one another with the end flange of one beam member in engagement with the outer edges of the inner flanges of the other beam member and with the flanges of the beam members extending generally perpendicularly to one another in the same plane to present a rabbet corner for receiving a corner of the sheet of construction material.

Additionally, the invention also provides a flexible torsion relieving assembly for connecting an elongated flexible spar to a host structure. Such assembly comprises a straight elongated torsion beam rigidly connected to one end of the spar. The torsion beam is disposed to extend transversely of the longitudinal center line of the spar and the same has an elongated bearing surface extending longitudinally thereof facing outwardly away from the end of the spar. A bearing plate having an elongated load bearing surface is attached to the host structure with the load bearing surface facing outwardly. The bearing surfaces are adapted for mated, sliding interengagement when the spar is connected to the host structure. In accordance with the invention the flexible torsion relieving assembly includes means defining an elongated slot extending through the elongated beam. The slot is disposed to extend along the beam in laterally spaced relationship relative to the spar and the same opens through the bearing surface of the beam. The assembly also includes securing means having a shank portion extending through the slot for holding the bearing surfaces together, whereby the bearing surfaces are able to move relatively when held together as a result of relative movement of the shank along the slot resulting from imposition of torsion on the spar.

The invention further provides a torsion resistant structure comprising a curved elongated, flexible spar having a lower end mounted on a generally horizontal surface of a host structure and an upper end mounted on a generally upright surface of a host structure. Each end of the spar is connected to the host structure by an assembly as defined above. Utilizing such construction it is often possible to quickly obtain building permits in view of the fact that the structure does not impose additional loads on the host structure.

The invention also provides a method for assembling a structure comprising sheets of materials secured between facing rabbets in adjacent spars. The method involves the provision of a pair of flexible elongated spars, each having a rabbet extending continuously along the entire length of the spar. The spars are installed in a desired side-by-side location with the ends of each spar secured to an existing structure and with the rabbets disposed in generally parallel facing relationship. The method involves the flexing of the spars relatively away from one another to present a widened area therebetween at the central portions of the spars. A first sheet of material (preferably a plastic panel) is inserted at the widened area, the edges of the first sheet of material are aligned with the rabbets and then the first sheet is moved along the rabbets toward one end of the spars until the rabbets at said one end of the spars enclose the edges of the first sheet. A second sheet of material is then inserted at said widened area and the edges of the second sheet are aligned with the rabbets so that the second sheet may be moved along the rabbets toward the other end of the spars until the rabbets at the other end enclose the edges of the second sheet. A third sheet of material is inserted at the widened area and the edges of this third sheet are aligned with the rabbets. Thereafter the spars are allowed to return to their undeflected position until the rabbets at the central portion of the spars enclose the edges of the third sheet. Such method is made possible as a result of the fact that the invention provides the flexible elongated spars having rabbets extending continuously along their entire length.

In a preferred sense, the spars are installed with one end of each spar mounted on a generally horizontal support surface and with the spars extending upwardly from the support surface so that the rabbets are spaced horizontally from one another. Preferably the spars are curved about a generally horizontal axis spaced equidistant from the spars whereby the sheets of material are flexed about said axis as the edges of the sheets are inserted into the rabbets. The upper end of each spar is secured to a generally upright surface.

In further accordance with the invention, the spars are maintained in their deflected condition by unflexed portions of the first and second sheets during the insertion of the third sheet. And then the spars are allowed to return to their original undeflected position as the sheets are flexed so that the edges thereof assume the shape of the rabbets.

In accordance with the invention, the operation required for assembling and erecting the structure may be accomplished from inside the area being covered.

DESCRIPTION OF THE PREFERRED EMBODIMENTS

Figure 1:
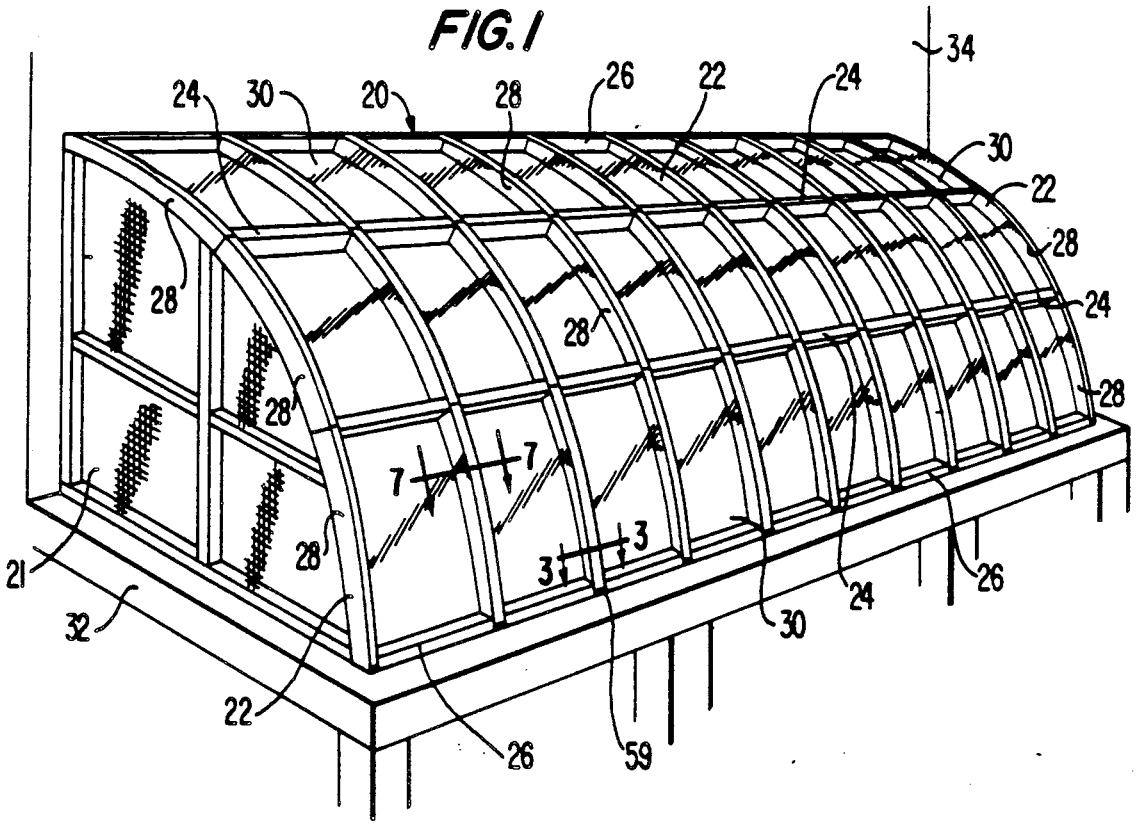
FIG. 1 is a vertical, perspective view of a sun space enclosing structure constructed in accordance with the concepts and principles of the invention.

The present invention provides the structural components and methodology for erecting a graceful mullion support structure 20 as illustrated in FIG. 1. Structure 20 is made up of a series of horizontally spaced curved spars 22, a series of vertically spaced straight horizontal beams 24 connected between spars 22 at the central regions of the structure, and a series of straight norizontal beams 26 disposed at the upper and lower ends of each spar 22. Each spar 22 is made up of a plurality (three as illustrated) curved beams 28 arranged in end-to-end relationship.

As illustrated, structure 20 includes a screened in end wall 21. However, the end walls are not an important aspect of the invention and may be left off completely if desired.

The spars 22 and horizontal beams 24 and 26 of structure 20 are designed to support flexed window panels 30, in accordance with the invention, and the structure 20 may be utilized as a cover for sun spaces such as slab patios, wooden decks and the like. As illustrated in FIG. 1, structure 20 is erected on a wooden deck 32 extending outwardly from an upright wall 34 of a host structure.

Preferably the panels may be formed from a polycarbonate sheet material available commercially from GE under the designation Excel-1. In accordance with the preferred embodiments described below, the sheets may be 32"×48" in size and ¼" thick.

Figure 2B:
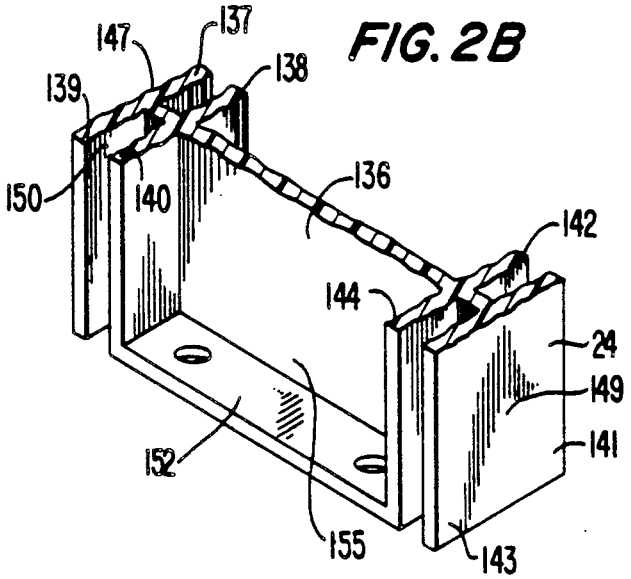
FIG. 2B is an isometric view of the end of a straight beam member formed in accordance with the principles and concepts of the invention and utilized in the construction of the structure of FIG. 1.
Figure 2A:
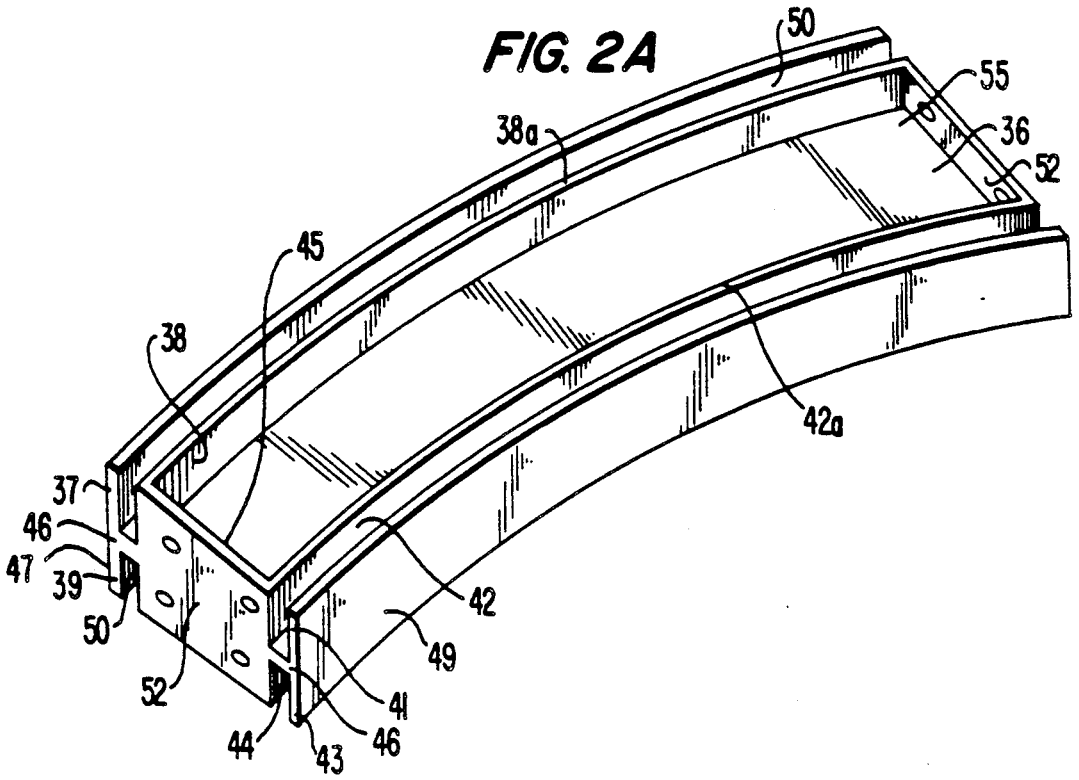
FIG. 2A is a perspective view of a curved beam member utilized in accordance with the invention to form the curved spars for the structure of FIG. 1.

The configuration of the curved beams 28 is illustrated in detail in FIG. 2A, and the configuration of the straight horizontal beams 24 is illustrated in detail in FIG. 2B. The cross-sectional configuration of beams 26 is identical with the cross-sectional configuration of beams 24.

Figure 3:
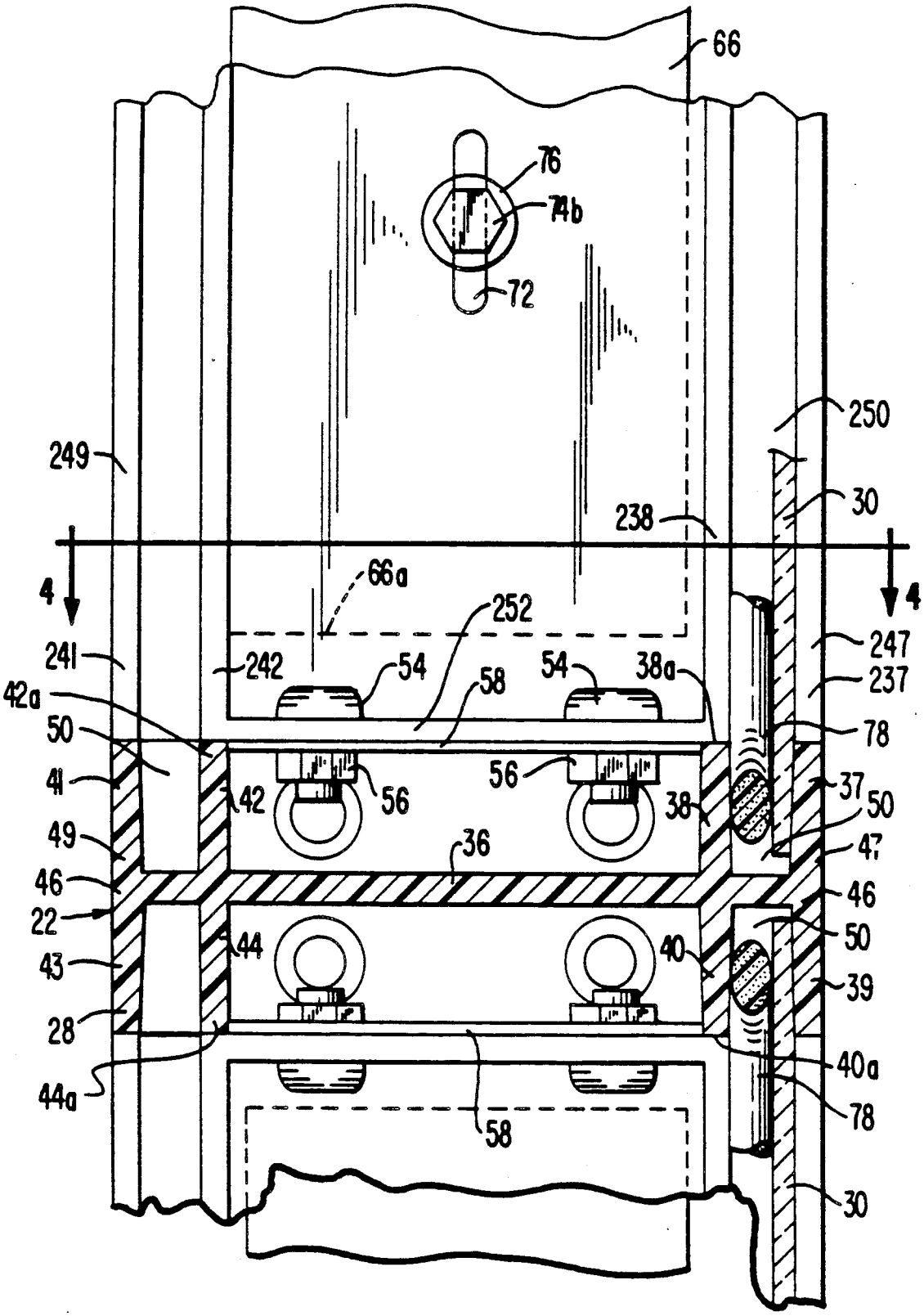
FIG. 3 is a cross-sectional view taken along the line 3—3 of FIG. 1 to show the details of the torsion relieving assembly which forms a part of the structure of the invention.

With reference first to the curved beam 28 of FIG. 2A, beam 28 includes an elongated, generally planar central web element 36, outer flanges 37, 39, 41 and 43 and respective corresponding inner flanges 38, 40, 42 and 44. In this regard, the cross-sectional configuration of curved beam 28 is clearly shown in FIG. 3. With reference to FIGS. 2A and 3, it can be seen that the central web element 36 of beam 28 has a pair of longitudinally spaced opposite ends 45 and 55 (FIG. 2A) and a pair of laterally spaced, longitudinally extending opposite edge portions 46 (FIG. 3). Edge portions 46 extend longitudinally along the entire length of web element 36.

Outer flanges 37, 39, 41 and 43 are each rigidly connected to web element 36 at respective edge portions 46, as can be seen in FIG. 3. The rigid connection comes about in the present case by virtue of the fact that curved beams 28, as well as straight beams 24 and 26, are all formed by injection molding to present a unitary integral piece. And as can be seen from FIG. 2A, each outer flanges 37, 39, 41 and 43 extends longitudinally of web element 36 along a corresponding edge portions 46. Flanges 37 and 39 together present a flange member 47 and flanges 41 and 43 together present a flange member 49. And the flange members 47 and 49 thus extend transversely outwardly away from web element 36 on opposite sides thereof.

Inner flanges 38, 40, 42 and 44 each extends longitudinally of web element 36 from one end 45 thereof to the other end 55 of web element 36. Flanges 38, 40, 42 and 44 each also extends transversely outwardly away from web element 36 to present respective outer edges 38*a*, 40*a*, 42*a* and 44*a*.

As can particularly be seen viewing FIG. 3, there is an inner flange 38, 40, 42 and 44 for each respective outer flange 37, 39, 41 and 43. Inner flanges 38, 40, 42 and 44 are rigidly connected to central web element 36 as a result of the fact that beam 28 comprises a unitary integral injection molded piece. And as can be seen from FIGS. 2A and 3, inner flanges 38, 40, 42 and 44 are all located between outer flange members 47 and 49. Each inner flange 38, 40, 42 and 44 is therefore disposed in laterally spaced, generally parallel relationship relative to a respective and corresponding outer flange 37, 39, 41 and 43 to present a respective rabbet slot or dado 50 therebetween. The rabbets 50 are each of a shape and size to receive and surround the edges of a ¼ plastic sheet. As can be seen viewing FIG. 2A, the rabbets 50 extend longitudinally the entire length of web element 36.

Each beam member 28 also includes an end flange 52 at each end thereof. Flanges 52 each extends laterally across web element 36 between inner flanges 38 and 40 and between inner flanges 42 and 44 at each end 45 and 55 of web element 36. Flanges 52 are rigidly connected to the opposite ends 45 and 55 of web element 36 and to inner flanges 38, 40, 42 and 44, again due to the fact that beam member 28 is a unitary, integral injection molded piece. As can be seen viewing FIG. 2A, end flanges 52 also extend transversely outwardly away from web element 36 on each side of the latter.

With reference to FIG. 2A, the central web element 36, inner flanges 38, 40, 42 and 44 and outer flange members 47 and 49 are all curved longitudinally of beam 28 about an axis which extends generally perpendicularly through the plane of web element 36.

Figure 4:
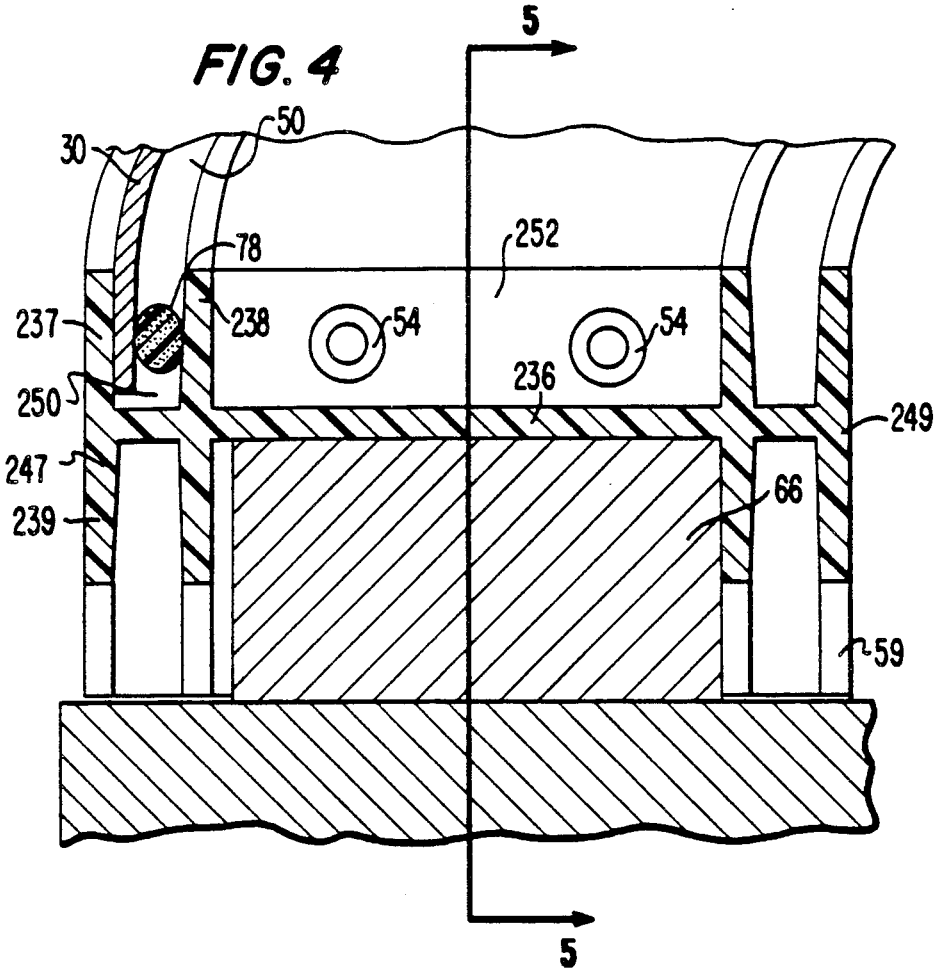
FIG. 4 is a cross-sectional view taken along the line 4—4 of FIG. 3.

A straight beam 24 used in the construction of support structure 20 is illustrated in FIG. 2B. Straight beam 24 is identical with curved beam 28 except it is straight rather than curved and the lengths may be different. The sectional configurations are the same. It is to be noted, with reference to FIG. 2B, that only one end of the straight beam 24 is illustrated; however, it will be appreciated that the other end of beam 24 has an identical configuration. And at least with regard to cross-sectional configuration, the straight beams 26 of structure 20 are also identical with the beams 24. The cross-sectional configuration of beam 26 is illustrated in FIG. 4. The component parts of beam 24 are numbered identically with the component parts of beam 28 except that the numbers are in the 100s. Thus, web element 136 of beam 24 corresponds with web element 36 of beam 28. Correspondingly, the component parts of beam 26 are numbered using the 200s and web element 236 thus corresponds with elements 36 and 136. Since these parts are identical there is no need for further description.

The beams 24, 26 and 28 may preferably be formed by injection molding from a glass filled polycarbonate resin. A suitable material is available commercially from GE and is designated as Lexan FL 1600. In the preferred form of the invention the beams 28 may be 48" long and the beams 24 and 26 may each be 30" long. In cross-section the web elements 36, 136 and 236 are preferably approximately 6" in depth and the outer flange members 47, 49, 147, 149, 247 and 249 are preferably approximately 2½" in width.

Figure 8:
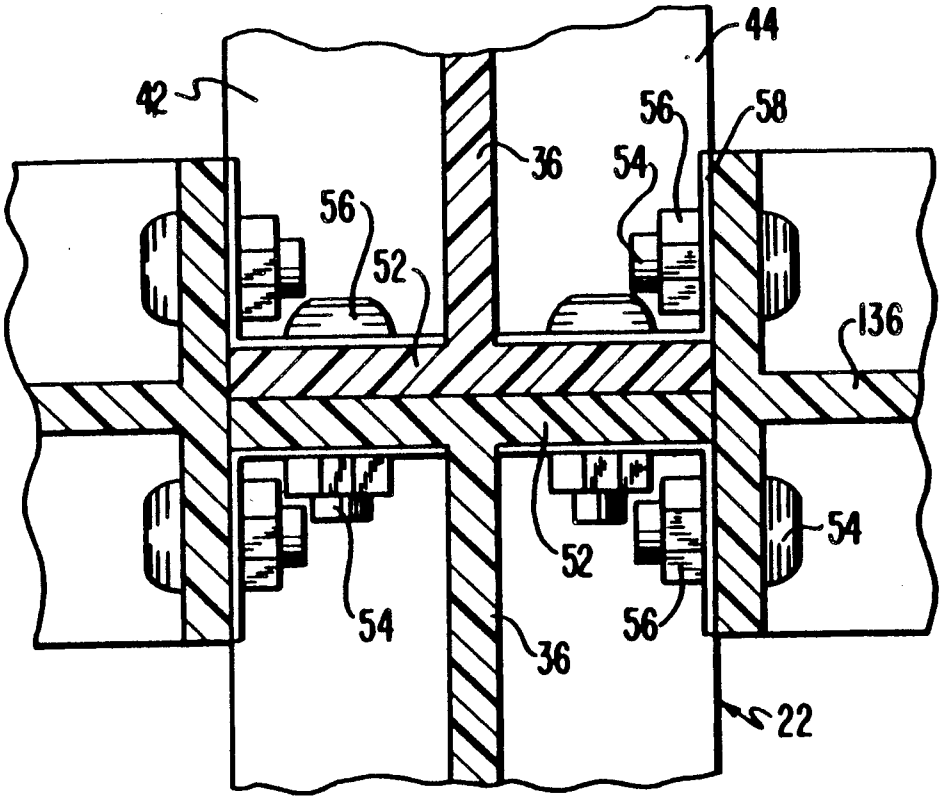
FIG. 8 is a cross-sectional view taken along the line 8—8 of FIG. 7.

A plurality of beams 28 ma be joined in end-to-end relationship to provide a spar 22. As shown in FIG. 8, the beam members 28 are positioned with their end flanges 52 disposed in mated contacting relationship. As can be seen in FIG. 8, the mated flanges 52 are held together by securing means in the form of button head cap screws 54 and hexnuts 56. As can also be seen in FIG. 8, the screws 54 and hexnuts 56 used for holding flanges 52 together also secure angle braces 58 which may be used to attach horizontal beams 24 to spars 22, again by button head screws 54 and hexnuts 56. FIG. 8 thus illustrates a typical joint for rigidly interconnecting the horizontal beams 24 in the central portion of the structure 20 with spars 22.

Figure 9:
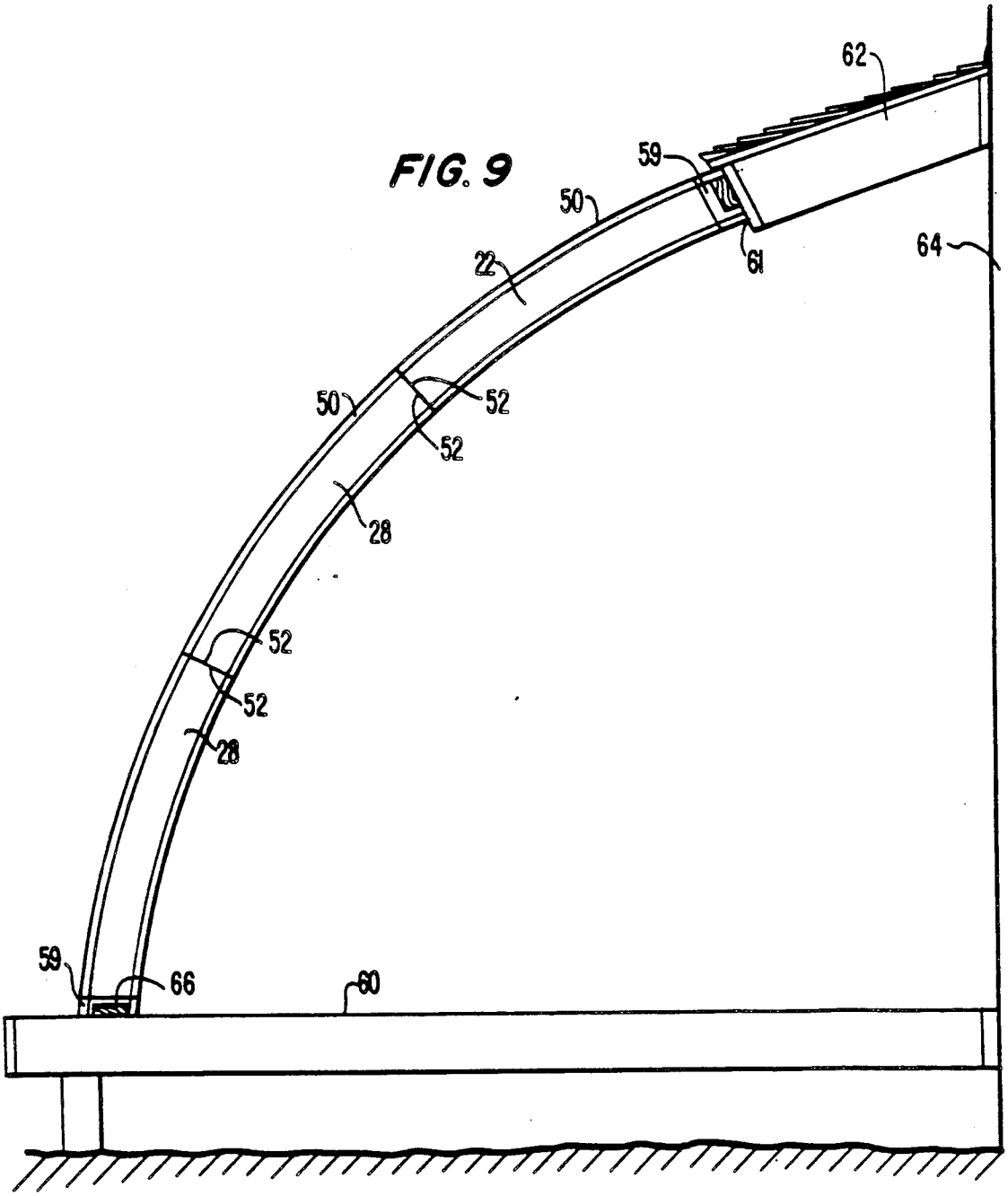
FIG. 9 is a schematic side elevational view of a curved flexible elongated spar during the construction of the structure of FIG. 1.

Typically, spars 22 each comprises three curved beams 28 disposed in end-to-end relationship as illustrated in FIG. 9. A filler 59, to be described hereinafter, is provided at each end of each spar 22. Thus, the curved beams 28 are joined in end-to-end relationship to provide a curved, flexible, elongated spar 22 which is made up of a plurality of the curved beams 28. Additionally, when beams 28 are joined together as illustrated in FIG. 9, the rabbets 50 of the individual curved beams 28 are disposed in longitudinal alignment.

In a preferred form of the invention, the screws 54, nuts 56 and angle braces 58 should all be formed from stainless steel to avoid corrosion.

As illustrated in FIG. 9, the lower end of spar 22 is mounted on a generally horizontal surface 60 of a host structure, which as illustrated is in the form of a wooden deck. The upper end of spar 22 is mounted on a generally upright surface 61 of a host structure, which in this instance is illustrated as an overhang 62 extending from a vertical wall 64. The overhang 62 is optional and spar 22 might just as well be mounted directly on wall 64. In the situation illustrated, the overhang may be used to improve the aesthetic appearance of the structure, provide additional reach and/or to adapt standardized components to fit the space to be covered. It should be also recognized that a knee wall could be provided beneath the lower end of spar 22 for additional head room.

Each end of spar 22 is connected to the host structure using a torsion relieving assembly as illustrated in FIGS. 3 through 6. Such assembly relieves torsional stresses resulting from pitching and heaving and allows slight movements of the structure without damage to the structure itself or its host. At each point of connection to a host structure, the torsion relieving assembly includes a load bearing plate 66 on each side of spar 22. The plates 66 may preferably be formed from 2×4 pieces of lumber, and in the preferred form of the invention each should be about 28" long. As illustrated in FIG. 3, the ends 66*a* of each plate 66 should preferably be spaced from spar 22 a sufficient distance to permit expansion and contraction and the deflection of the structure resulting from changes in environmental conditions. The plates 66 may be firmly attached to the host structure using screws 68 (FIG. 6) and each plate 66 provides an elongated load bearing surface 70 to support the lateral thrust of the spar 22.

As indicated above, each spar 22 includes a filler 59 at each end thereof. Each filler 59 is used to accommodate the use of standard lengths for the beams 28 and adapt spars 22 for tilting. Generally speaking, the fillers 59 may be prepared at the job site by carefully measuring the space requirements and then cutting a filler 59 to fit. The fillers 59 may be prepared by simply cutting the end from a beam 28 and finishing the filler 59 by cutting it to a correct length and angle to accommodate the available space. The fillers 59 also provide a rigidifying element at each end of the spar 22 facilitating connection of the cross torsion beams 26 as illustrated in FIGS. 3 through 6. With reference to FIG. 1, it can be seen that beams 26 extend between adjacent spars 22. However, in FIG. 6 the beams 26 are cut away to illustrate the interrelationship between each beam 26 and the corresponding underlying load bearing plate 66.

Figure 5:
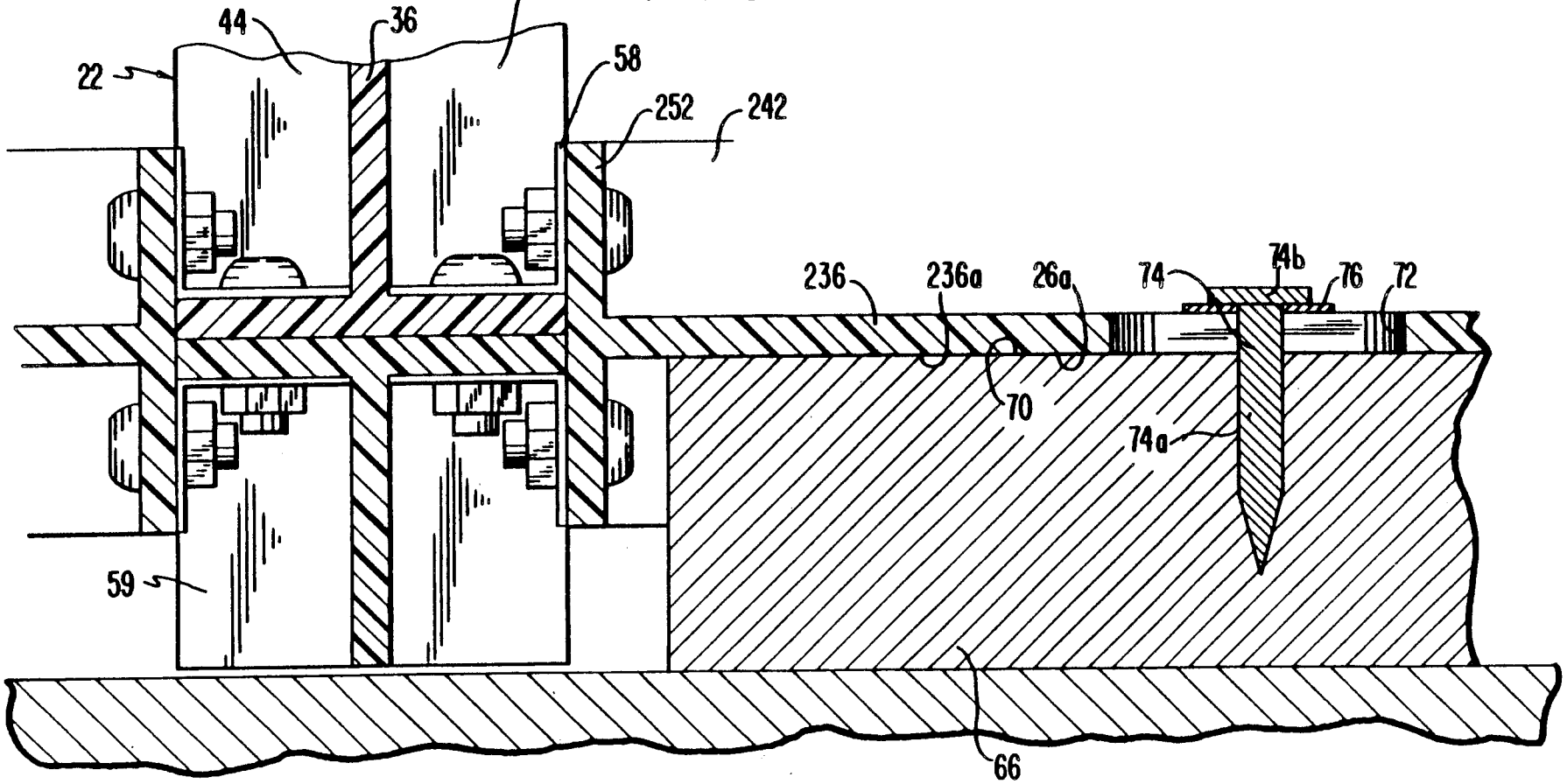
FIG. 5 is a cross-sectional view taken along the line 5—5 of FIG. 4.
Figure 6:
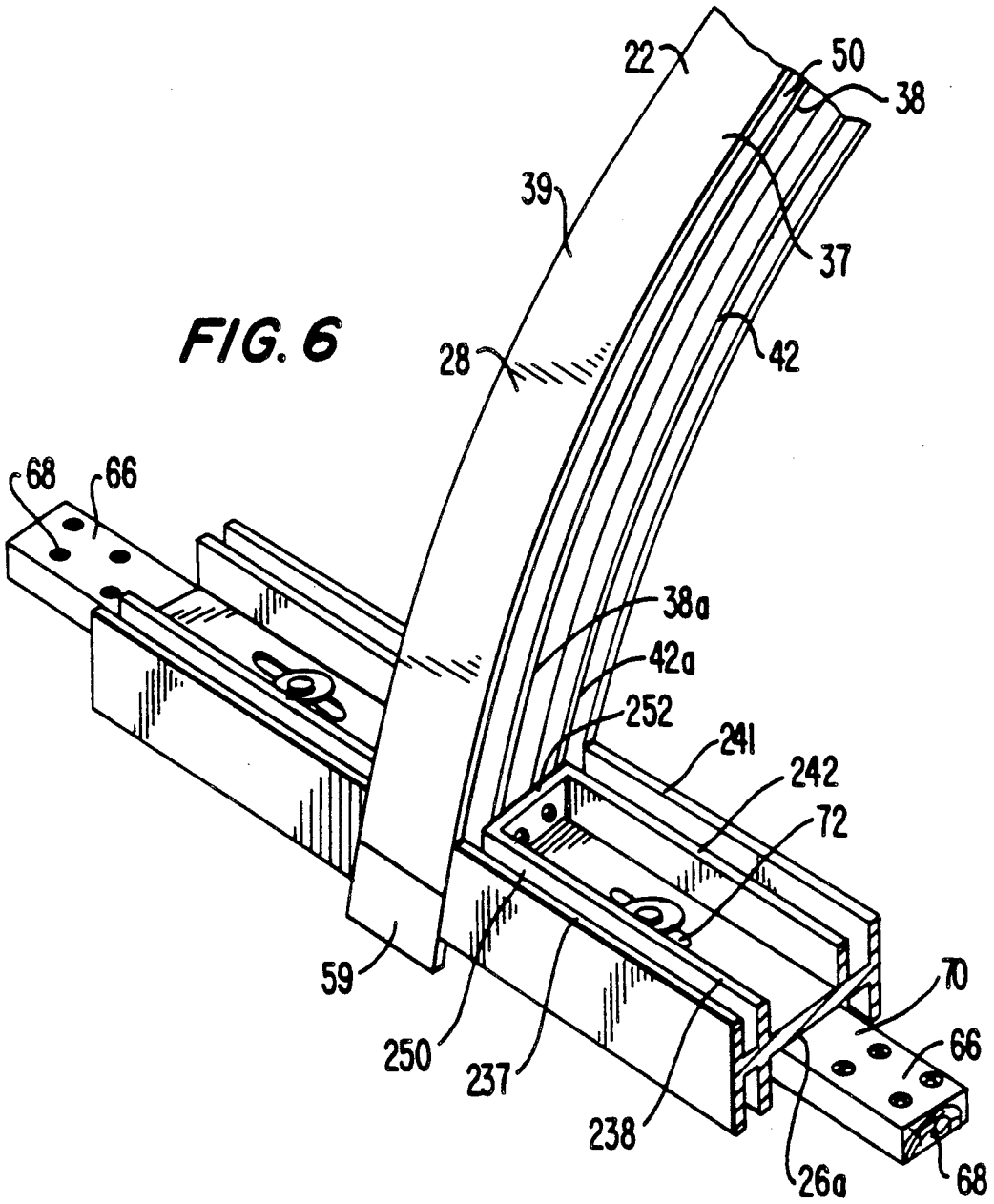
FIG. 6 is a perspective view, with parts broken away to illustrate the constructional details of the torsion relieving assembly of FIGS. 3, 4 and 5.

Filler 59, which as indicated above may comprise an end segment cut from a beam 28, has an end flange 52. The end flange 52 of each filler 59 is disposed in facing mate relationship relative to the end plate 52 of the beam 28 at the end of spar 22. End flange 52 of filler 59 and the end flange 52 of beam 28 are connected together using screws 54 and nuts 56 as illustrated in FIG. 5. Again, an angle brace 58 may be included to provide a point of attachment for torsion beam 26 as illustrated. The torsion beams 26 are then rigidly connected to spars 22 by screws 54 and nuts 56.

Each torsion beam 26 has an elongated bearing surface 26*a* that extends along beam 26 and faces outwardly away from the end of the spar 22 as shown. As can be seen in FIG. 5, the surface 26*a* is located on the central web element 236 of beam 26. And in this regard, it should be noted that beam 26 extends transversely away from the longitudinal axis (or center line) of spar 22.

Each beam 26 includes structure which defines an elongated slot 72 that extends through web 236. Slot 72 extends along beam 26 and is laterally spaced from spar 22. Securing means in the form of a large lag bolt 74 has a shank portion 74*a* that extends through slot 72 for holding beam 26 and plate 68 together with surfaces 26*a* and 70 disposed in mated sliding engagement, as illustrated in FIG. 5. A washer 76 may be provided to adapt the configuration of the head 74*b* of bolt 74 to the configuration of slot 72. In this regard, it should be understood that the lag bolt 74 should be snug against web 236 but should not be too tight. In a preferred form of the invention, the center of each slot 72 should be located approximately 6" from the center line of the spar 22 to achieve a good balance of torsion characteristics. This distance could, however, be greater or smaller if desired to change the torsional characteristics of the assembly.

As illustrated in FIG. 5, the shank portion 74*a* of bolt 74 extends through slot 72 for holding surfaces 26*a* and 70 together and yet permit relative longitudinal movement of beam 26 relative to plate 66. As will be appreciated by those skilled in the art to which the present invention pertains, surfaces 70 and 26*a* will tend to move relatively as a result of the imposition of torsion on spar 22. But since shank portion 74*a* is free to move along slot 72, the torsional forces are not transferred to plate 66 or to the host structure upon which plate 66 is mounted. Thus, plate 66 and beam 26 and the other components described above provide a flexible torsion relieving assembly at the end of the spar 22 for connecting the latter to the host structure. In this connection, it should be noted that although FIGS. 3 through 6 illustrate the torsion relieving assembly at the lower end of spar 22, the attachment and connection of spar 22 at the upper end thereof may be identical.

Figure 7:
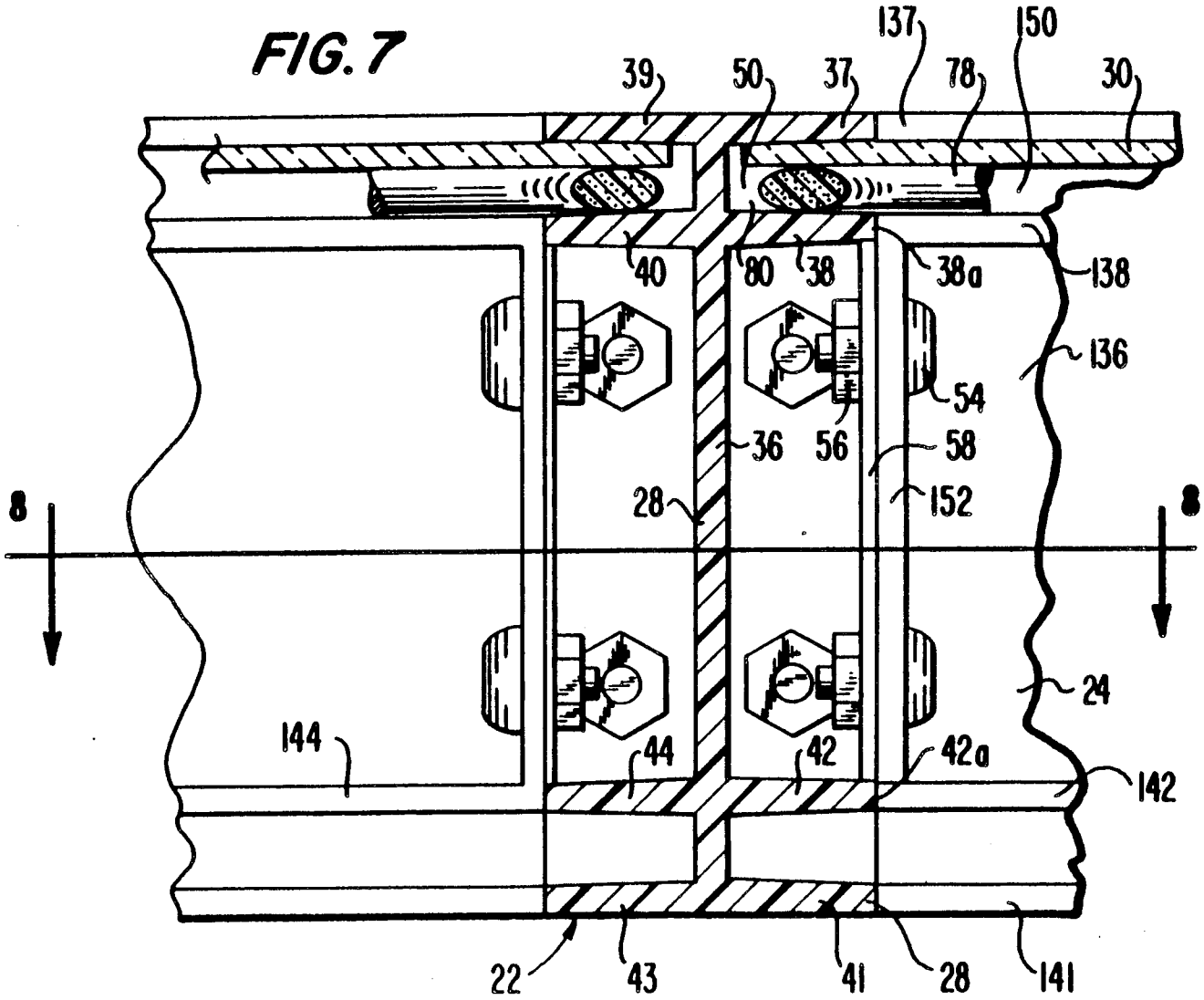
FIG. 7 is a cross-sectional view taken along the line 7—7 of FIG. 1 to illustrate the details of the intersection between the spars and horizontal beams of the invention.

The horizontal beams 24 at the central portions of structure 20 are connected to spars 22 in exactly the same way that the horizontal beams 26 are connected at the upper and lower ends of the spars 22. The connection between horizontal beams 24 and spars 22 is illustrated in FIGS. 7 and 8. The assembly of the spars 22 including the angle braces 58 has been described above. Beams 24 are simply firmly attached to angle braces 58 by the screws 54 and nuts 56. In this regard, it is to be noted that the end flanges 52 of one beam 24 (the beam to the right in FIG. 7) are in engagement with the outer edges 38*a* and 40*a* of inner flanges 38 and 40 of the beams 28 of spar 22. Additionally, the inner flanges 138 and 142 of said beam 24 are aligned respectively in the same plane as the inner flanges 38 and 42 of beam 28. Furthermore, the outer flanges 137 and 141 of said beam 24 are aligned in the same plane as outer flanges 37 and 41 of beam 28. This can be seen viewing FIG. 7. Thus, the vertically extending rabbet 50 of spar 22 is aligned with the horizontally extending rabbet 150 of beam 24. And such rabbets 50 and 150 are perpendicularly disposed to present a rabbet corner 80 configured to receive the corner of a window panel 30 as illustrated in FIG. 7. This configuration is common throughout structure 20 at each intersection between a beam 24 or 26 and a spar 22.

The structure 20 may be conveniently erected using the method illustrated in FIGS. 10 through 14. In these figures only two spars are illustrated; however, the same methodology is applicable to the entire structure. In this regard, if the structure is open at each end, then the construction should begin in the middle and work outwardly toward each end. On the other hand, if one end is against another structure, then the construction should start at the end which is against such other structure and the work should move outwardly therefrom.

In constructing structure 20, flexible, elongated spars 22 are provided. As explained previously in connection with FIG. 9, each spar 22 has a rabbet 50 which extends continuously along the entire length thereof. The spars 22 are installed in the desired location in side-by-side relationship with the ends thereof secured to an existing host structure as described above. The rabbets 50 are disposed in facing relationship as can be appreciated viewing FIG. 13. in FIG. 13 the spar closest to the viewer has been broken away to show the rabbet 50 in the spar which is furtherest from the viewer of FIG. 13. As indicated previously, the spars 22 are joined to an upright surface 61 and to a generally horizontal surface 60.

Figure 10:
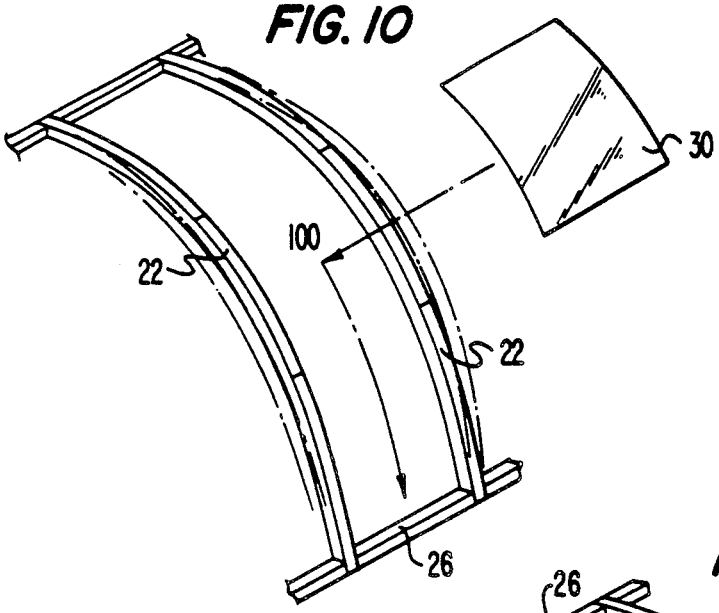
FIGS. 10, 11, 12, 13 and 14 are schematic views illustrating the flexible elongated spar of the invention and the steps of the method utilized in accordance with the invention for assembling the sun space structure of FIG. 1.

With reference to FIG. 10, the spars 22 are deflected (bent) relatively away from one another and into the dashed line position illustrated there. This presents a widened area 100 that is wider than the width of a panel 30. A first panel 30 is inserted between spars 22 at widened area 100, the edges of the panel are aligned with rabbets 50, and the first panel 30 is then moved downwardly along the rabbets 50 until the rabbets 50 at the lower ends of spars 22 enclose at least a portion of the edges of the panel 30. Thus, the first panel 30 follows the path of the arrow in FIG. 10. And it is also to be recognized that panel 30 will be received in the rabbet 250 of the horizontal beam 26 at the lower end of spars 22.

Figure 11:
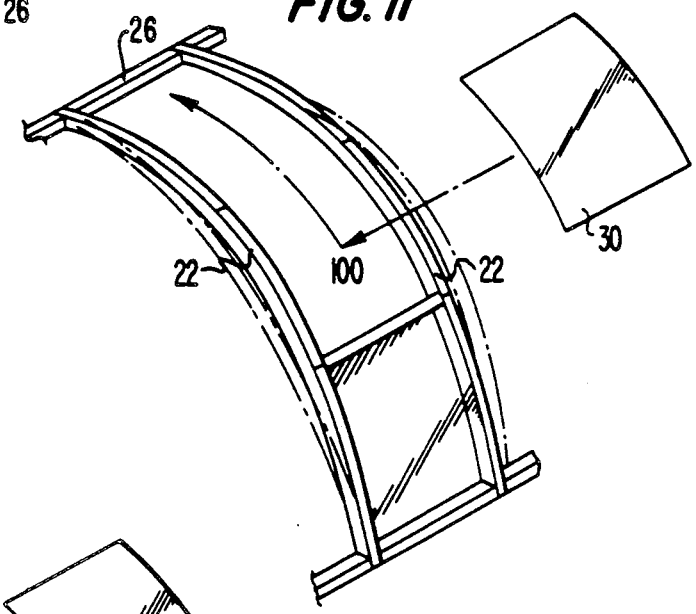
Figure 12:
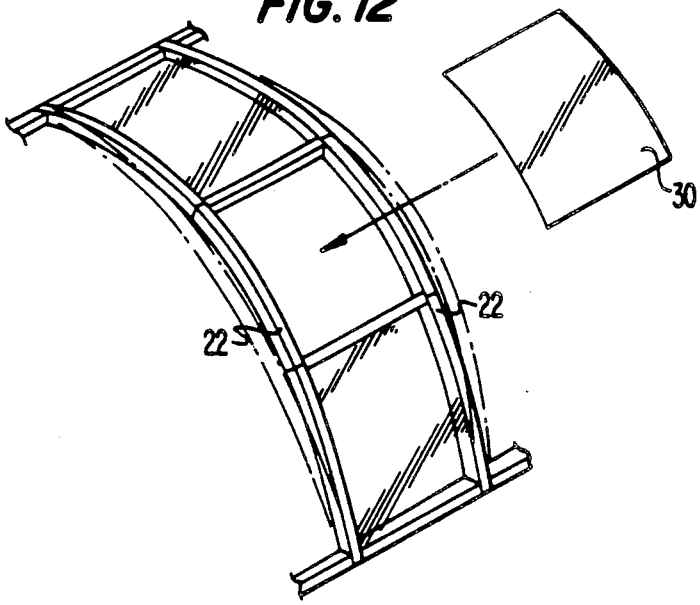

A second window panel 30 is similarly inserted along the path indicated by the arrows in FIG. 11. Thus, the second panel 30 is inserted at the widened area 100 and is aligned with the rabbets 50 and moved upwardly along the rabbets until at least a portion of the edges of the sheet 30 are enclosed by the rabbets at the upper end of spars 22. Again it should be noted that sheet 30 must be inserted into the rabbet 250 of the uppermost beam 26 as illustrated in FIG. 11. After the first and second panels 30 are in place, a third panel is inserted at widened area 100 as illustrated in FIG. 12, and spars 22 are then allowed to return to their original unflexed condition with rabbets 50 surrounding the opposite edges of panels 30.

Figure 14:
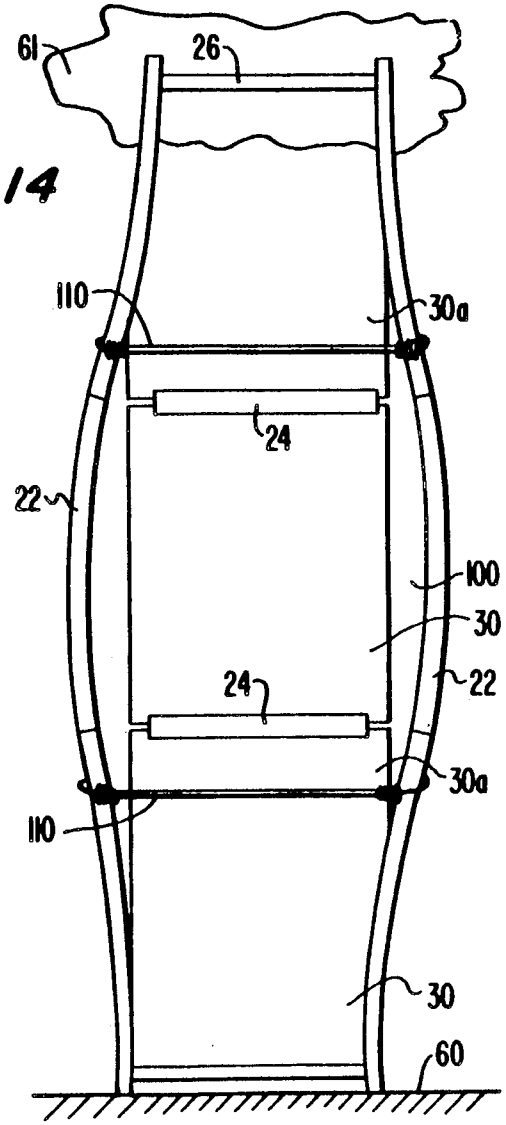

As can be seen viewing FIG. 14, the spars 22 are curved about a horizontal axis which is spaced equidistant from spars 22. The panels 30 are flexed about the same axis when the edges thereof are disposed in the rabbets 50 of spar 22. The curvature of the spars is utilized to facilitate the insertion and flexing of the panels.

Figure 13:
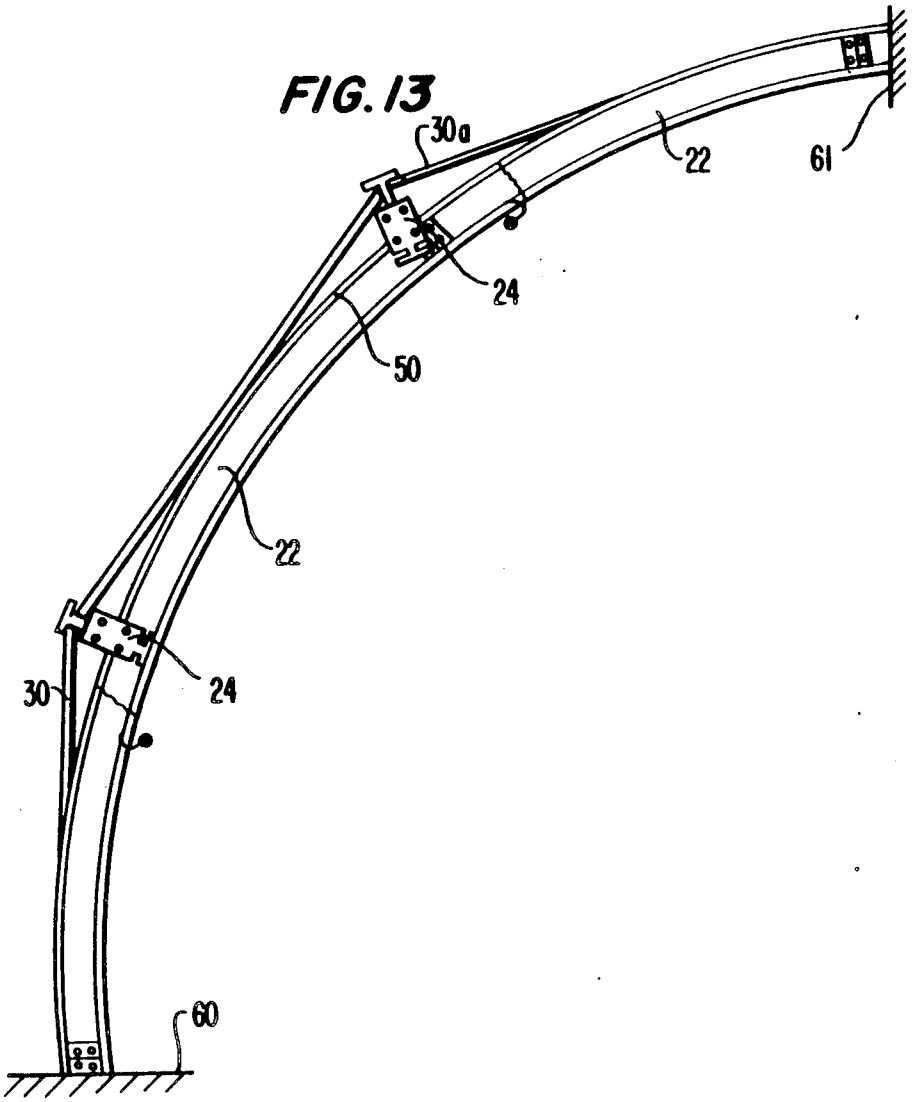

After the first and second panels have been pushed to their respective ends and inserted into the rabbets 250 of the beams 26 at the top and at the bottom of the structure, an unflexed portion **30*a* of each panel extends into the widened area 100. Flexible cords 110 are then employed to pull spars 22 together sufficiently to contact the edges of the panels 30 at the unflexed portions 30*a* thereof. This has a double effect. Firstly, the contact between the spars 22 and the panels 30 keep the latter in place at the upper and the lower ends of the structure. Additionally, the contact between the spars 22 and the panels 30 maintains the spars 22 in their deflected condition as illustrated in FIG. 14. A cross beam 24 is placed on the lower panel 30 by inserting the latter into a rabbet 150 of the lower cross beam 24. The central panel 30 is then placed in the opposite rabbet 150 of beam 24. And finally, the upper beam 24 is placed on the central panel 30 with the latter received in a rabbet 150 of the upper cross beam 24. The panels 30 are then pulled toward the spars 22 using beams 24 and as this occurs the lower edge of the upper panel 30 will be able to move into a rabbet 150 of the upper beam 24 as shown in FIG. 13. Again, using cross beams 24, the panels are now all pulled toward spars 22. The panels 30 are flexed by this maneuver until all of the panel edges assume the shape of the spars 22 and the rabbets 50 thereof. When this occurs the spars 22 will return to their initial unflexed position with the edges of the flexed panels 30 encompassed by rabbets 50, 150 and 250. Finally, the cross beams 24 may be connected to spars 22 as illustrated in FIGS. 7 and 8**.

After the panels 30 and crossbeams 24 are in place, the entire structure may be sealed using sealing rope 78 pushed into the rabbets 50, 150 and 250 as illustrated in FIGS. 3, 4 and 7. Additional sealing may be provided by placement of a butyl adhesive, for example, between the adjoining end flanges 52 of the beams 28 of each spar 22 and between the end flanges of the beams and the angle braces 58.

It is an important feature of the invention that all of the operations described above that are required for assembling and erecting the structure 20 may be conducted from inside the space being enclosed. Since the entire structure 20 may be erected and assembled from inside the space to be covered, dangerous climbing and/or the use of cranes may be avoided even for installations at elevated locations such as on top of buildings.

The invention thus provides a rigid structure for enclosing a sun space utilizing a system of curved and straight plastic beams to form a graceful mullion support structure. Clear or tinted window panels may be flexed and installed as the beam support structure is fastened together. The structure does not require a foundation because the plastic spars and beams are capable of torsionally deflecting. The structure may be used as an awning, a privacy area with open ends or a sun space with screened in end walls. By simply tilting the spars 22 and careful fitting of the fillers 59, the structure can be made to fit a variety of space configurations. The panels may be tinted for privacy and minimization of the heat from the sun.

I claim:

1. A method for assembling a space enclosure structure comprising:

providing a pair of flexible elongated spars, each of said spars having a pair of spaced ends and a rabbet extending continuously along the spar from one of said ends to the other;

installing the spars in a desired side-by-side location with the ends of each spar secured to an existing structure and with the rabbets disposed in generally parallel, facing relationship;

flexing said spars relatively away from one another to present a widened area therebetween at the central portions of the spars;

inserting a first sheet of material at said widened area, aligning the edges of the first sheet with the rabbets and moving the first sheet along the rabbets toward one end of the spars until the rabbets at said one end of the spars enclose the edges of the first sheet;

inserting a second sheet of material at said widened area, aligning the edges of the second sheet with the rabbets and moving the second sheet along the rabbets toward the other end of the spars until the rabbets at said other end enclose the edges of the second sheet;

inserting a third sheet of material at said widened area and aligning the edges of the third sheet with the rabbets; and allowing the spars to return to their undeflected position until the rabbets at said central portions of the spars enclose the edges of the third sheet.

2. A method as set forth in claim 1, wherein said spars are installed with one end of each spar mounted on a generally horizontal support surface and with the spars extending upwardly from the support surface so that the rabbets are spaced horizontally from one another.

3. A method as set forth in claim 2, wherein said spars are curved about a generally horizontal axis spaced equidistant from the spars whereby said sheets of the material are flexed about said axis as the edges of the sheets are inserted in the rabbets.

4. A method as set forth in claim 3, wherein the other end of each spar is secured to a generally upright surface.

5. A method as set forth in claim 4, wherein the spars are maintained in a deflected condition by unflexed portions of the first and second sheets during said insertion of the third sheet and said spars are allowed to return to their undeflected position when the sheets are flexed so that the edges thereof assume the shape of the rabbets.

* * * * *